US008197094B2

(12) United States Patent
Quadri et al.

(10) Patent No.: US 8,197,094 B2
(45) Date of Patent: Jun. 12, 2012

(54) STAGE LIGHTING FIXTURE

(75) Inventors: Pasquale Quadri, Torre de' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 112 days.

(21) Appl. No.: 12/877,360

(22) Filed: Sep. 8, 2010

(65) Prior Publication Data

US 2011/0080735 A1 Apr. 7, 2011

(30) Foreign Application Priority Data

Sep. 10, 2009 (IT) ..... MI2009A1556

(51) Int. Cl.
*F21V 33/00* (2006.01)

(52) U.S. Cl. ..... 362/279; 362/277; 362/311.09; 362/319; 362/332; 362/340

(58) Field of Classification Search ..... 362/277, 362/279, 280, 281, 311.09, 319, 332, 335, 362/336, 337, 339, 340
See application file for complete search history.

(56) References Cited

U.S. PATENT DOCUMENTS

| | | | | |
|---|---|---|---|---|
| 4,151,584 | A * | 4/1979 | Labrum | 362/302 |
| 4,462,067 | A * | 7/1984 | Altman | 362/268 |
| 6,478,453 | B2 * | 11/2002 | Lammers et al. | 362/294 |
| 2010/0061107 | A1 * | 3/2010 | Jurik | 362/319 |

* cited by examiner

*Primary Examiner* — Laura Tso
(74) *Attorney, Agent, or Firm* — Leason Ellis LLP

(57) ABSTRACT

A stage lighting fixture having a casing extending along a longitudinal axis; a light source housed in a closed end of the casing to emit a light beam substantially along an optical axis; an objective lens located at an open end of the casing; and beam size adjusting means located between the light source and the objective lens to intercept the beam. The beam size adjusting means have an optical element, in turn having a first region with a first concave beam incidence surface of first beam diffusion properties, and a second region with a second concave beam incidence surface of second beam diffusion properties.

16 Claims, 5 Drawing Sheets

STAGE LIGHTING FIXTURE

The present invention relates to a stage lighting fixture.

BACKGROUND OF THE INVENTION

Known stage lighting fixtures comprise a casing extending along a longitudinal axis; a light source housed inside a closed end of the casing to emit a light beam substantially along an optical axis; and beam size adjusting means positioned to intercept the beam.

The beam size adjusting means adjust the size of the image projected by the lighting fixture, and normally comprise a zoom device defined by a plurality of movable lenses.

Increasing demand for more compact stage lighting fixtures, however, makes it necessary to minimize the size of the beam size adjusting means.

SUMMARY OF THE INVENTION

It is an object of the present invention to provide a stage lighting fixture that is compact, easy to produce, and at the same time provides for effectively adjusting the size of the projected image.

According to the present invention, there is provided a stage lighting fixture as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
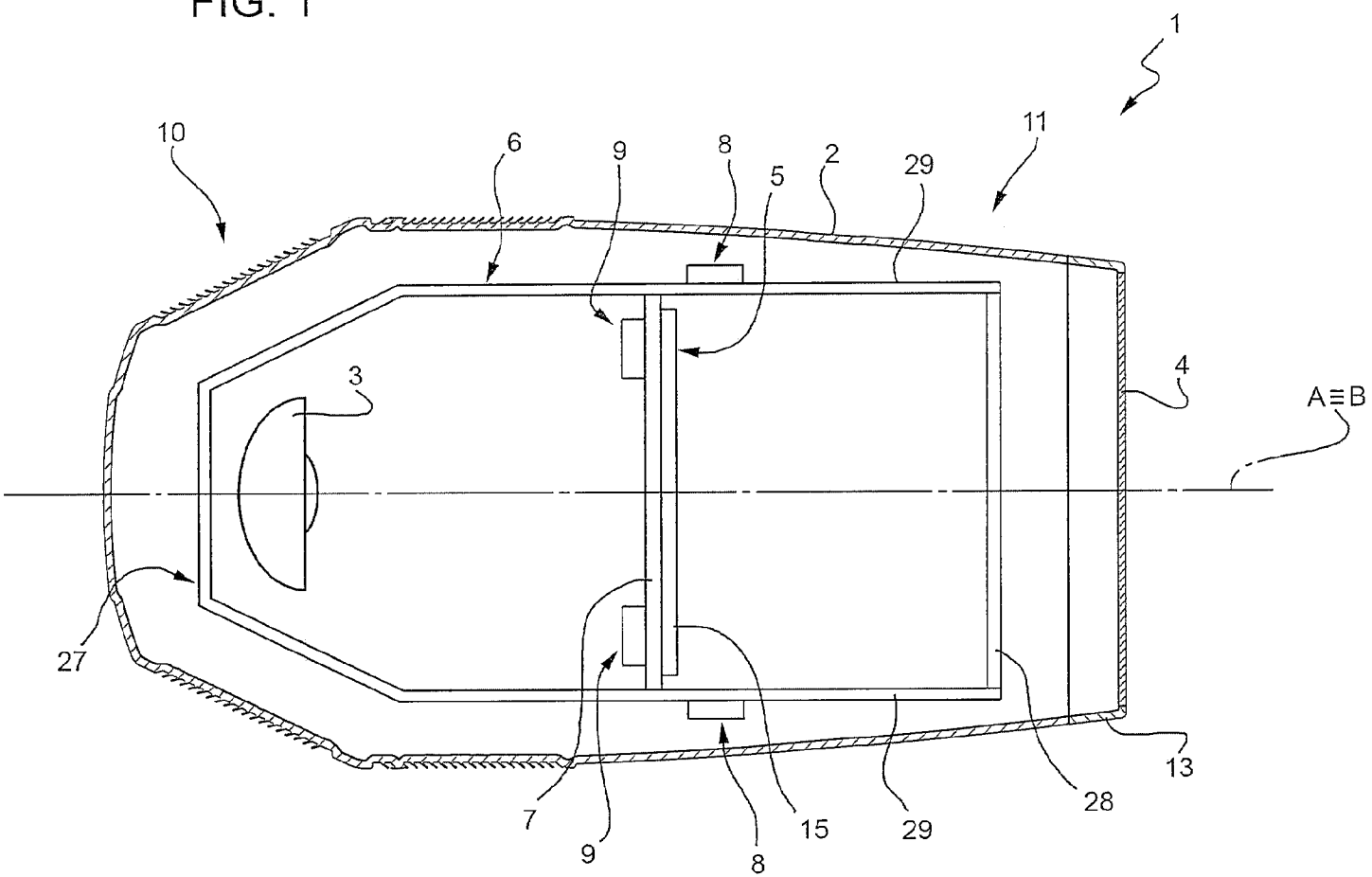
FIG. 1 shows a partly sectioned schematic, with parts removed for clarity, of a stage lighting fixture in accordance with the present invention.

Number 1 in FIG. 1 indicates a stage lighting fixture comprising a casing 2, a light source 3, an objective lens 4, beam size adjusting means 5, a frame 6, a carriage 7, drive means 8 for driving the carriage 7 and actuating means 9 for operating beam size adjusting means 5.

Casing 2 extends along a longitudinal axis A, and has a closed end 10, and an open end 11 opposite the closed end along axis A.

Light source 3 is housed inside the closed end 10 of casing 2, and emits a light beam substantially along an optical axis B.

In the non-limiting example described and illustrated, optical axis B coincides with longitudinal axis A of casing 2.

Objective lens 4 is circular, and is fixed to the open end 11 of casing 2, coaxially with optical axis B, so as to close casing 2. More specifically, objective lens 4 is fixed to a supporting ring 13, in turn fitted to casing 2, e.g. by means of screws (not shown for the sake of simplicity).

Figure 2:
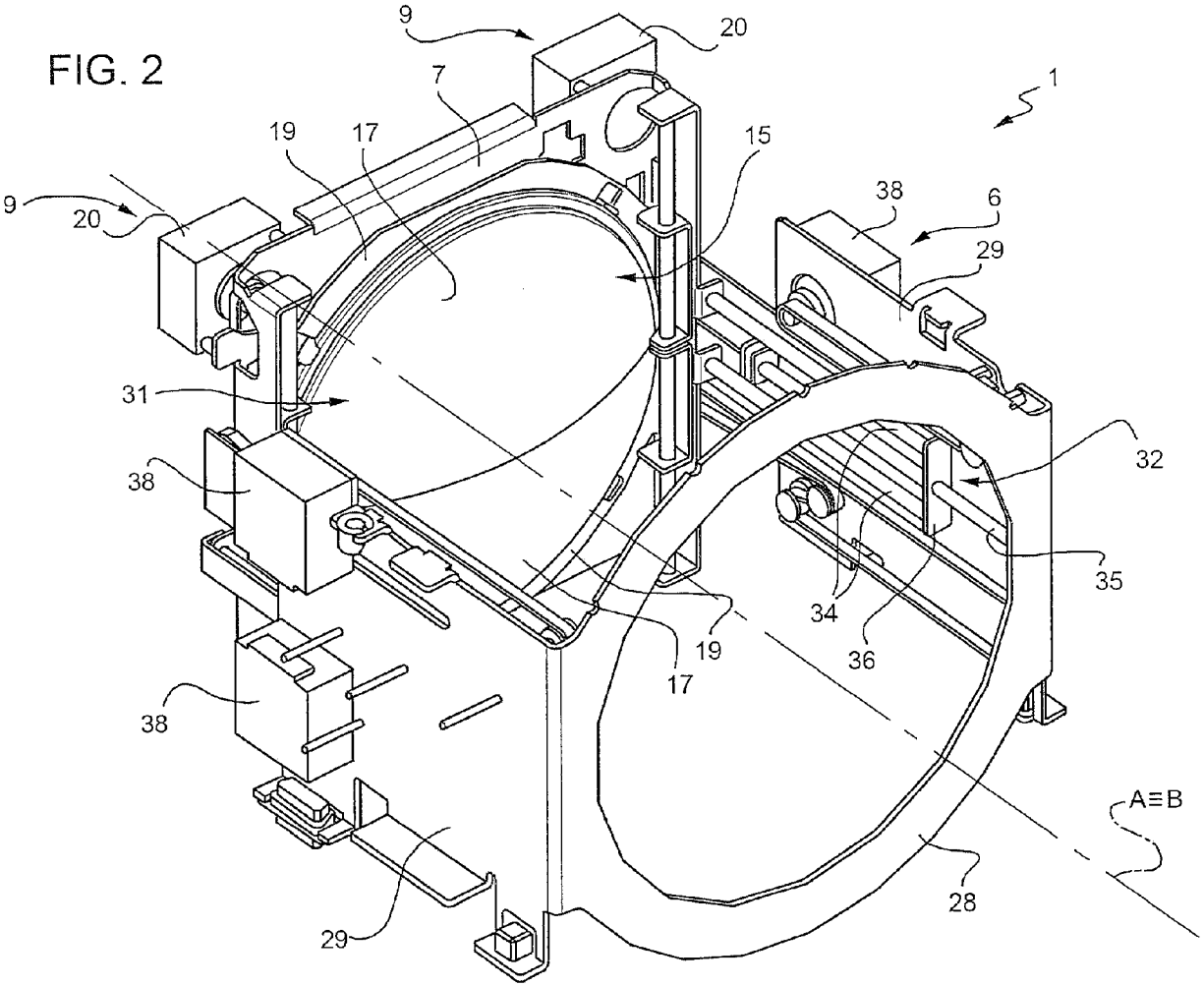
FIG. 2 shows a view in perspective, with parts removed for clarity, of a first detail of the FIG. 1 lighting fixture.
Figure 3:
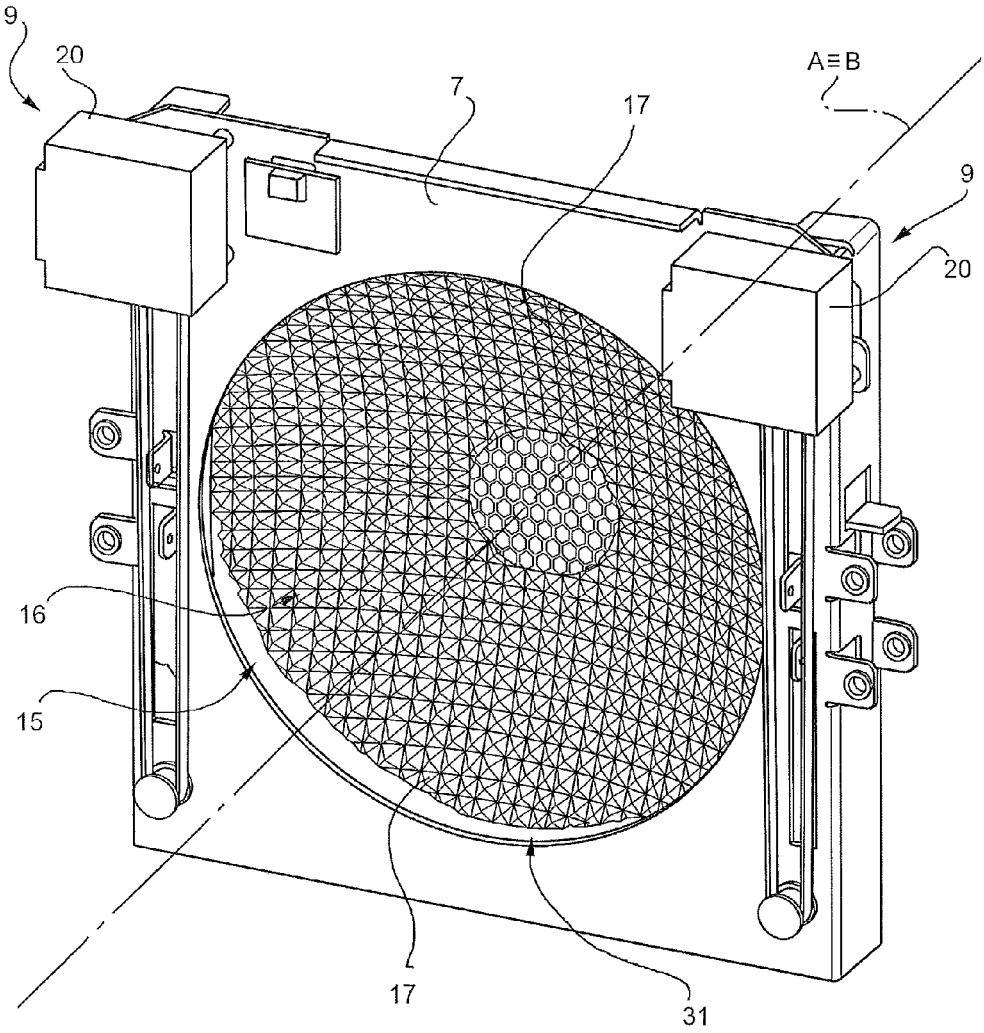
FIG. 3 shows a view in perspective of a second detail of the FIG. 1 lighting fixture in a first operating position.
Figure 4:
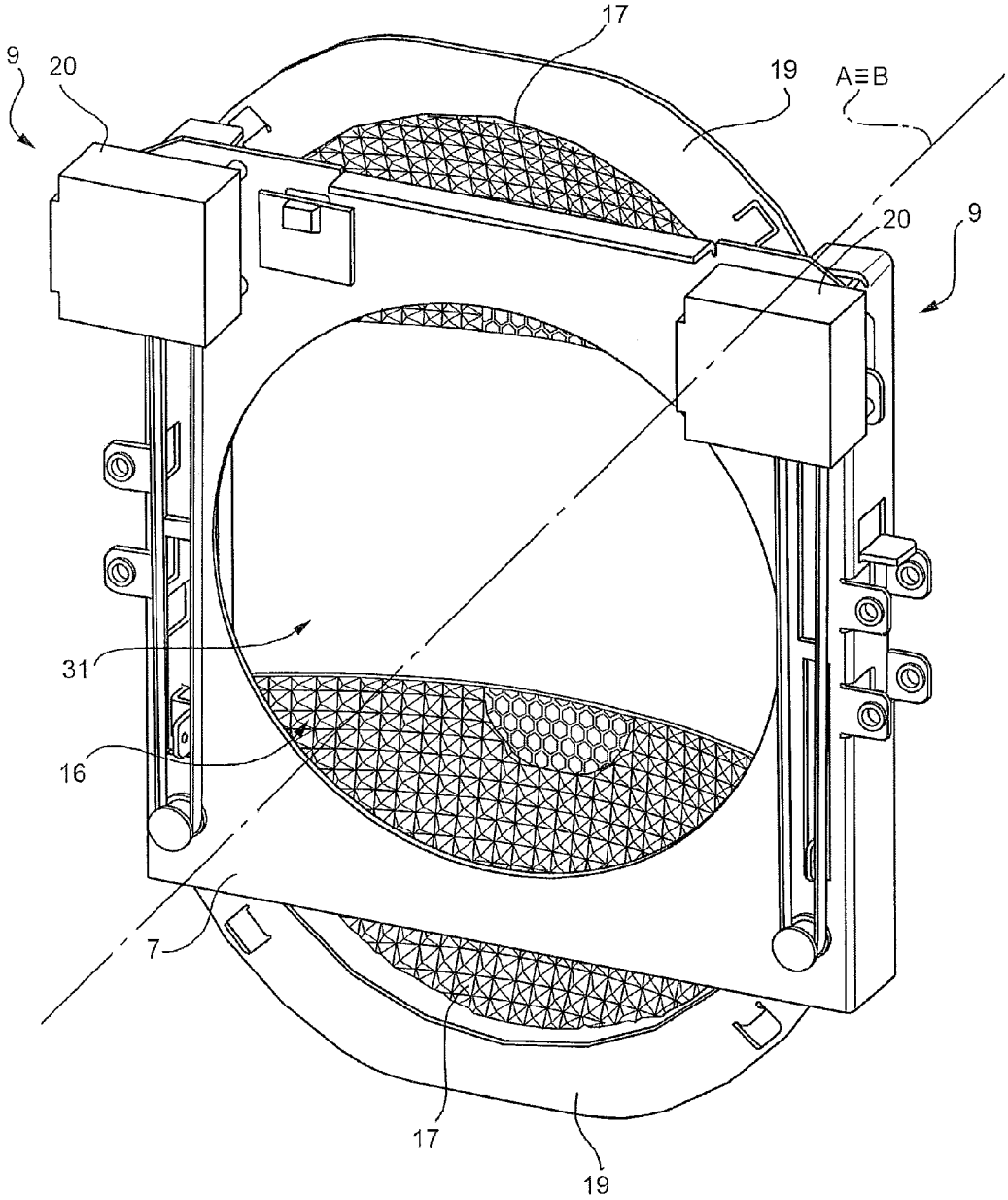
FIG. 4 shows a view in perspective of the second detail in FIG. 3 in a second operating position.
Figure 5:
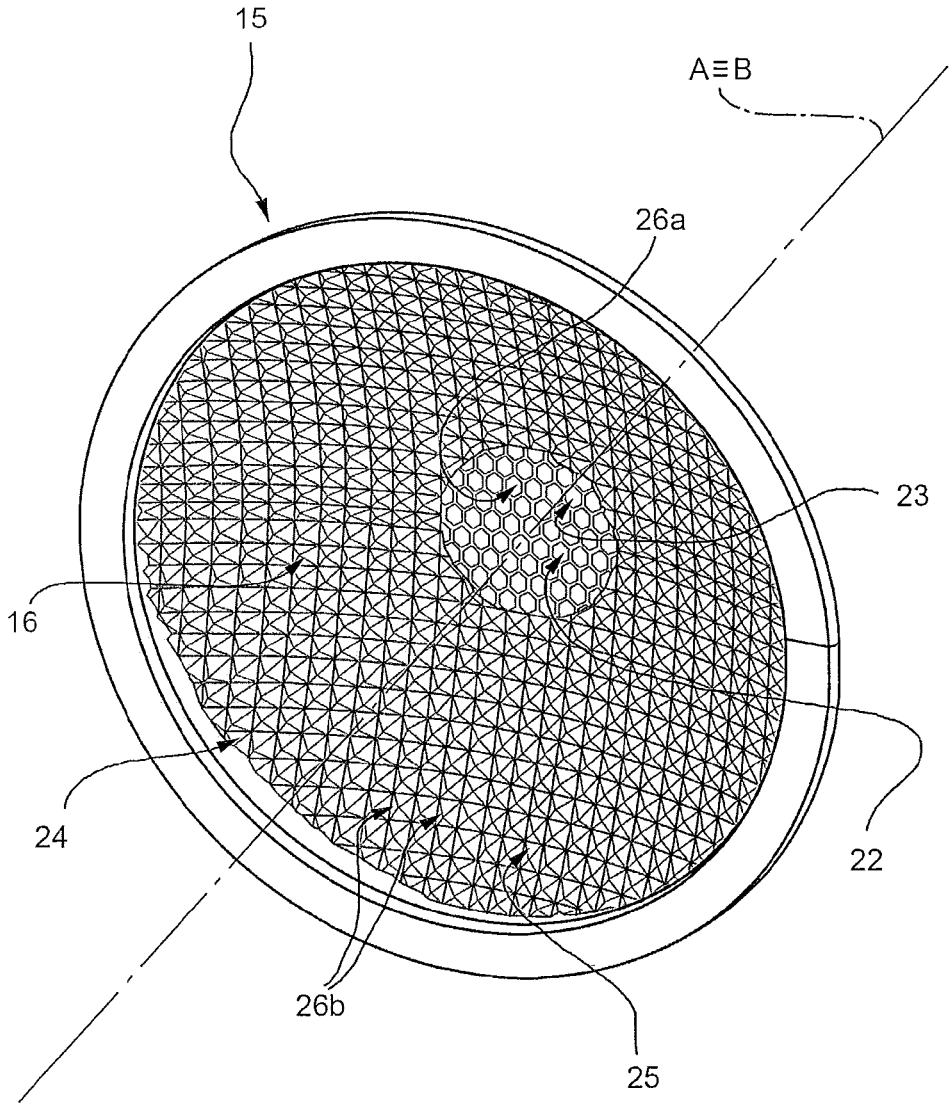
FIG. 5 shows a view in perspective of a third detail of the FIG. 1 lighting fixture.

With reference to FIG. 2, beam size adjusting means 5 comprise an optical element 15 in the form of a disk with a concave beam incidence surface 16 (shown in FIGS. 3, 4 and 5). More specifically, optical element 15 is defined by two half-disks 17 separable preferably in a direction crosswise to the beam.

Each half-disk 17 is fitted to a respective half-ring support 19 moved by actuating means 9, which preferably comprise two electric belt-drive motors 20 for moving respective half-ring supports 19 between a first position, in which half-disks 17 are positioned contacting to intercept the beam, as shown in FIG. 3, and a second position, in which half-disks 17 are parted to let the beam through, as shown in FIG. 4.

Electric motors 20 are preferably mounted on carriage 7.

With reference to FIG. 5, optical element 15 has a first region 22 with a first concave beam incidence surface 23 of first beam diffusion properties; and a second region 24 adjoining first region 22, and which has a second concave beam incidence surface 25 of second beam diffusion properties.

More specifically, first region 22 is circular, is located at the centre of optical element 15, and comprises a plurality of honeycomb lenses **26*a* over first concave beam incidence surface 23**, to produce a predetermined flare angle, preferably of roughly 20-40°, of the incident beam.

Second region 24 is annular, extends about first region 22, and comprises a plurality of prismatic elements **26*b* over second concave beam incidence surface 25. Prismatic elements 26*b* are preferably square-based pyramids with rounded and/or bevelled tips; and second region 24 of optical element 15** is substantially designed to produce a predetermined flare angle, preferably of roughly 40-80°, of the incident beam.

With reference to FIG. 1, frame 6 is located inside casing 2, and comprises a supporting structure 27 for supporting light source 3; a plate 28 located at open end 11, upstream from objective lens 4 along optical axis B; and two side plates 29 parallel to optical axis B and connected to plate 28 and supporting structure 27.

With reference to FIG. 2, plate 28 is perpendicular to optical axis B, and has an opening to let the beam through; and plate 28 and side plates 29 are preferably made of metal.

Carriage 7 supports optical element 15 and, in the example shown, is in the form of a preferably metal, substantially quadrangular plate having a main hole 31 for passage of the beam; a plurality of holes for housing and attaching actuating means 9; and a plurality of holes of various sizes for attaching optical element 15. Carriage 7 is substantially perpendicular to optical axis B, and is mounted to slide along two guides 32 (only one shown in FIG. 2) fixed to respective side plates 29 of frame 6.

More specifically, in the non-limiting example shown, each guide 32 comprises two movable bars 34 fixed to carriage 7; a fixed bar 35 connected to respective side plate 29 and to plate 28; and a plate 36, which has three aligned holes engaged respectively by movable bars 34 and fixed bar 35, and slides along fixed bar 35. Movable bars 34 and fixed bar 35 are parallel to optical axis B.

Drive means 8 for driving the carriage comprise four electric motors 38 fixed in pairs to side plates 29.

In the non-limiting example shown, electric motors 38 are belt-drive types.

In a variation, not shown, of the present invention, carriage 7 is driven by one or more worm-drive electric motors.

Each motor 38 is controllable electronically by a microprocessor.

Motors 38 are controlled to move carriage 7 along optical axis B into a plurality of positions ranging between a minimum position, in which the beam is intercepted by at least a portion of first concave beam incidence surface 23 of optical element 15, and a maximum position, in which the beam is intercepted by substantially the whole of first concave beam incidence surface 23 and the whole of second concave beam incidence surface 25 of optical element 15.

In the positions of carriage 7 between the minimum and maximum positions, the diffusion properties of the beam incidence surface mostly intercepting the beam are predominant. That is, if intercepted mainly by first concave beam incidence surface 23, the beam is diffused in accordance with the properties of surface 23; whereas, if intercepted mainly by second concave beam incidence surface 25, the beam is diffused in accordance with the properties of surface 25.

Lighting fixture 1 also comprises beam processing and filtering means (not shown in the drawings, for the sake of simplicity) located between light source 3 and beam size adjusting means 5 to produce special effects on the beam, and which normally comprise beam colouring assemblies, a diaphragm, gobos, and prisms.

By virtue of the design of optical element 15, the beam remains uniform and homogenous as carriage 7 is moved to adjust the size of the beam.

Clearly, changes may be made to stage lighting fixture 1 as described and illustrated herein without, however, departing from the scope of the accompanying Claims.

The invention claimed is:

1. A stage lighting fixture comprising:

a casing (2);

a light source (3) arranged at a closed end (10) of the casing (2) and adapted to emit a light beam substantially along an optical axis (B);

an objective lens (4) located at an open end (11) of the casing (2); and beam size adjusting means (5) located between the light source (3) and the objective lens (4) to intercept the beam;

the lighting fixture (1) being characterized in that the beam size adjusting means (5) comprise an optical element (15), in turn comprising a first region (22) with a first concave beam incidence surface (23) of first beam diffusion properties, and a second region (24) with a second concave beam incidence surface (25) of second beam diffusion properties.

2. A lighting fixture as claimed in claim 1, wherein the first region (22) and the second region (24) are contiguous.

3. A lighting fixture as claimed in claim 1, wherein the first region (22) is circular and located at the center of the optical element (15), and the second region (24) is annular and extends about the first region (22).

4. A lighting fixture as claimed in claim 1, wherein the first region (22) of the optical element (15) comprises a plurality of honeycomb lenses (26*a*) over the first concave beam incidence surface (23).

5. A lighting fixture as claimed in claim 1, wherein the second region (24) of the optical element (15) comprises a plurality of prismatic elements (26*b*) over the second concave beam incidence surface (25).

6. A lighting fixture as claimed in claim 5, wherein the prismatic elements (26*b*) are square-based pyramids with rounded and/or bevelled tips.

7. A lighting fixture as claimed in claim 1, wherein the first region (22) of the optical element (15) is designed to produce a roughly 20-40° flare angle of the incident beam.

8. A lighting fixture as claimed in claim 1, wherein the second region (24) of the optical element (15) is designed to produce a roughly 40-80° flare angle of the incident beam.

9. A lighting fixture as claimed in claim 1, wherein the optical element (15) is a disk defined by two separable half-disks (17).

10. A lighting fixture as claimed in claim 9, and comprising actuating means (9) for moving the half-disks (17).

11. A lighting fixture as claimed in claim 1, wherein the optical element (15) is movable along the optical axis (B).

12. A lighting fixture as claimed in claim 11, and comprising a frame (6) fixed to the casing (2), and a carriage (7); the carriage (7) supporting the optical element (15), and being movable with respect to the frame (6) along the optical axis (B) of the beam.

13. A lighting fixture as claimed in claim 12, wherein the carriage (7) is substantially perpendicular to the optical axis (B) of the beam.

14. A lighting fixture as claimed in claim 12, and comprising drive means (8) for moving the carriage (7).

15. A lighting fixture as claimed in claim 14, wherein the drive means (8) comprise at least one motor (38).

16. A lighting fixture as claimed in claim 15, wherein the motor (38) is an electric belt-drive motor.

* * * * *